US005378039A

United States Patent [19]

Lie

[11] Patent Number: 5,378,039

[45] Date of Patent: Jan. 3, 1995

[54] TORSION SPRING AND ADJUSTABLE MOUNTING FOR CHAIR

[75] Inventor: Tore Lie, Moelv, Norway

[73] Assignee: Ring Mekanikk AS, Moelv, Norway

[21] Appl. No.: 983,553

[22] PCT Filed: Aug. 20, 1990

[86] PCT No.: PCT/NO90/00134

§ 371 Date: Feb. 8, 1993

§ 102(e) Date: Feb. 8, 1993

[87] PCT Pub. No.: WO92/03072

PCT Pub. Date: Mar. 5, 1992

[51] Int. Cl.[6] ..... A47C 1/032

[52] U.S. Cl. ..... 297/301; 297/302

[58] Field of Search ..... 297/301, 302, 300, 304

[56] References Cited

U.S. PATENT DOCUMENTS

| | | | |
|---|---|---|---|
| 2,424,753 | 7/1947 | Herold . | |
| 2,778,626 | 1/1957 | Klepp | 248/609 X |
| 3,031,164 | 4/1962 | Desanta . | |
| 4,603,830 | 8/1986 | Franck | 297/304 X |
| 4,865,384 | 9/1989 | Desanta . | |
| 4,966,411 | 10/1990 | Katagiri et al. | 297/301 |
| 5,018,287 | 5/1991 | Estkowski et al. | 297/301 X |

FOREIGN PATENT DOCUMENTS

| | | |
|---|---|---|
| 0363833 | 10/1989 | European Pat. Off. . |
| 675688 | 5/1939 | Germany . |

*Primary Examiner*—Peter R. Brown

*Attorney, Agent, or Firm*—Banner, Birch, McKie & Beckett

[57] ABSTRACT

A straight type torsion spring is clamped together at two ends, the ends being rotatable in relation to each other against the torsion spring force. The torsion spring includes at least four identical torsion rods abutting laterally along their entire extension, thereby utilizing the relatively large twisting angle of the small dimension torsion rods combined with the total torsion force of the torsion spring rods, each of which is independently twisted helically when activating the spring. An adjustable mounting for a chair uses a torsion rod of this type, a seat frame, a back frame, a mounting bracket, and a tilting lever. One end of the torsion spring is secured to the mounting bracket, an upper end of the tilting lever is pivotally connected to a front portion of the seat frame and a rear portion of the seat frame is pivotally connected to the back frame. A forward end of the back frame is pivotally and adjustably connected to the mounting bracket and the mounting bracket is secured to a second end of the torsion spring such that the connection of the back frame to the mounting bracket thereby enables adjustment of the angle of the back frame.

3 Claims, 1 Drawing Sheet

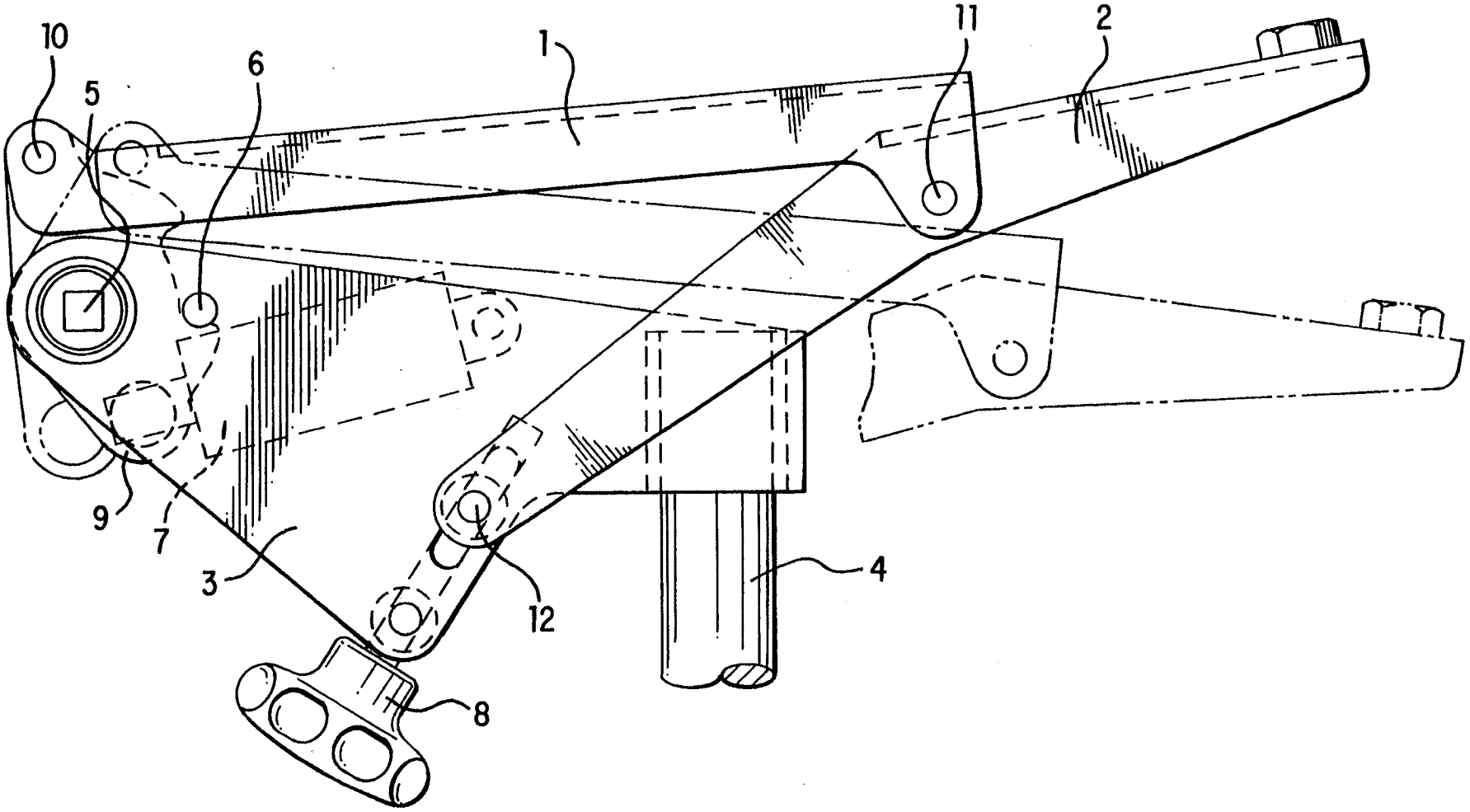
1
2
3
4
5
6
7
8
9
10
11
12

TORSION SPRING AND ADJUSTABLE MOUNTING FOR CHAIR

The present invention is related to a torsion spring and an adjustable mounting for a chair according to the preamble of the claims.

Mountings for chairs and specially office chairs generally provide for the possibility of adjusting the inclination of the seat and the position of the back as well, independently or not. The height of the seat usually is adjusted with the position of the mounting on a central column or the position of the column in a base device.

Mountings of the above mentioned type normally comprise a spring function, thereby making it possible for the user to tilt the back of the chair, the seat or both. Additionally the user may adjust the height and the angles of the seat and the back to a comfortable position for the user.

For designing chairs as such it is advantageous that the mounting is small thereby giving more freedom to design work, also of cosmetic reasons, as a mounting with smaller dimensions may be easily hidden behind the seat.

The torsion spring according to the present invention provides a spring having smaller dimensions as compared to known torsion springs having the same spring force and twisting angle.

The adjustable mounting according to the present invention provides a special motion picture as compared to known mountings as a combination with the way of articulating the seat, the back and the mounting bracket. A very comfortable chair is achieved which easily may be adjusted to a desired angle for the back and the seat of the chair. These advantages are achieved with the torsion spring and the mounting according to the present invention as defined by the features stated in the claims.

The only figure FIG. 1, discloses a side view of the adjustable mounting, disclosing also the position of the seat and the back frames in a relaxed position of the chair.

The drawing discloses a mounting bracket 3 fixed to a center shaft 4 which connection may be adjustable in the height, whereby the center shaft 4 is fixed to a not disclosed base as well known in the art.

It has been discovered that the spring function of a torsion spring may be substantially increased when the torsion spring instead of only one bar comprises at least four rods, all being clamped together at the ends of the spring.

Principally the spring effect of a torsion spring will increase with the spring bar cross section dimension. When increasing the cross section, however, the twisting angle will be limited. Torsion springs having small dimensions make possible larger twisting angles, but will naturally be correspondingly weaker, e.g. the spring force is decreased.

It is found however, that a combination of a plurality of smaller torsion rods give the desired high spring force, thereby substantially maintaining a relatively large twisting angle, as each of the rods will be twisted separately in a helical line.

The friction forces between the single rods in a multi-rod torsion spring to a certain degree also contribute to increase the spring force in relation to one single bar having a cross section corresponding to the total cross section of all rods. The result of the combined effect from torsion forces of the small dimension rods and the friction forces, result in the spring force being achieved with a certain total spring cross section of substantially shorter spring length than is the case with a single rod torsion spring having the same cross section, the torsion spring comprising several single rods, thereby maintaining a desired, relatively large twisting angle.

A torsion spring 5 of the above disclosed type is disclosed in the drawing, arranged in a mounting bracket 3. In the middle between the two side walls of the bracket 3 a tilting lever 9 is clamped to a pipe whose other end is clamped to one end of the torsion spring 5. A second pipe is connected to the other end of the torsion spring 5, the other end of the pipe being connected to a lever against which a screw connected with the bracket 3 is adjustable.

To the upper end of the lever 9 the front portion of a seat frame 1 is articulated or pivotally mounted thereto. The lever 9 preferably comprises abutments limiting the rotation angle of the lever 9 to a desired amount, by means of a stop pin 6 connected with the bracket 3 for limiting the rotation angle in two outermost positions.

The rear portion of the seat frame 1 is articulated or pivotally mounted to a back frame 2, the rear end of which is connected to the back seat and the front end of which being connected to the bracket 3. Preferably the connection between the back frame 2 and the bracket 3 is adjustable by means of an adjustable knob 8 thereby making it possible to change the point around which the back frame 2 is rotating, to achieve a desired angle of the back seat, adapted to the user, in the upright position as well as in the relaxed position.

The distance between the torsion spring 5 and the articulation or pivotal connection point 10 between the lever 9 and the seat frame 1 as well as the possible rotation angle for the lever 9, limited by the stop pin 6, may be such that it is comfortable for the user when pressing the back seat backwards, the front end of the seat frame 1 thereby simultaneously being moved backwards to achieve a better position and an angle for the knees when in the relaxed position.

Furthermore the position of the articulation or pivotal connection point 11 between the seat frame 1 and the back frame 2 may be such that the distance between the articulation 11 and the articulation 12 between the back seat frame 2 and the bracket 3 as well as the distance between the torsion spring 5 and the articulation 12, provide a suitable inclination of the back seat which is rigidly connected with the back seat frame 2, in the raised position as well as in the relaxed position.

A dampening and locking device 7 is arranged within the bracket 3, connecting the lever 9 to the bracket such as by a gas spring 7. Suitably this connection may be one end of the lever 9 opposite the articulation 10.

The well known gas springs used in similar chairs do not provide for the possibility of adjusting the spring force. Gas springs, however, have the advantage of small physical dimensions with the benefit of freedom for the chair designer. An advantageous combination of small spring dimensions and adjustment possibility is however achieved with the chair according to the present invention, comprising the inventive multi-rod torsion spring.

I claim:

1. An adjustable mounting for a chair including a seat frame, a back frame and a mounting bracket, said adjustable mounting comprising:

a torsion spring secured to said mounting bracket, said torsion spring having first and second ends;

a tilting lever connected to said torsion spring;

wherein an upper end of said tilting lever is pivotally connected to a front portion of said seat frame and a rear portion of said seat frame is pivotally connected to said back frame;

wherein a forward end of said back frame is pivotally and adjustably connected to said mounting bracket such that the connection of said back frame to said mounting bracket thereby enables adjustment of the angle of said back frame; and wherein a stop pin is fixed to said mounting bracket, thereby limiting the rotational movement of said tilting lever between two outermost positions in which said stop pin abuts shoulders on said lever and thus limiting movement of the seat frame.

2. An adjustable mounting according to claim 1 wherein said torsion spring is mounted between said seat frame and said mounting bracket, thereby distributing the desired torsional forces between the first end and second ends of the torsion spring.

3. An adjustable mounting according to claim 1 wherein the entire length of said torsion spring is utilized to produce a spring force.

* * * * *